US005213733A

United States Patent [19]

Hwu et al.

[11] Patent Number: 5,213,733

[45] Date of Patent: May 25, 1993

[54] METHOD OF MAKING SYNTHETIC FIBERS CONTAINING PHOTOCHROMIC PIGMENT

[75] Inventors: Yean-Rong Hwu; Chi-Chung Bai; Li-Chang Tao; Der-Guey Luo; Andrew T. Hu, all of Hsin-Chu, Taiwan

[73] Assignee: Industrial Technology Research Institute, Taiwan

[21] Appl. No.: 711,043

[22] Filed: Jun. 3, 1991

[51] Int. Cl.[5] ..... D01F 1/04

[52] U.S. Cl. ..... 264/78; 8/497; 264/211; 524/89; 524/92; 524/95; 524/110

[58] Field of Search ..... 264/78, 211, 349; 8/494, 497; 523/171, 351; 524/87, 89, 92, 95, 107, 110

[56] References Cited

U.S. PATENT DOCUMENTS

| | | | |
|---|---|---|---|
| 3,649,696 | 3/1972 | Kazan, Jr. | 568/333 |
| 3,714,181 | 1/1973 | Lantos | 548/223 |
| 3,964,823 | 6/1976 | Trozzolo | 359/241 |
| 4,166,043 | 8/1979 | Uhlmann et al. | 252/600 |
| 4,367,170 | 1/1983 | Uhlmann et al. | 252/586 |

FOREIGN PATENT DOCUMENTS

| | | | |
|---|---|---|---|
| 51-087177 | 7/1976 | Japan . | |
| 58-113203 | 7/1983 | Japan . | |
| 60-021975 | 2/1985 | Japan . | |
| 61-026687 | 2/1986 | Japan . | |
| 61-053387 | 3/1986 | Japan . | |
| 62-39208 | 2/1987 | Japan | 264/78 |
| 1-168911 | 7/1989 | Japan . | |

OTHER PUBLICATIONS

Kamogawa, H. (1969) *J. App. Poly. Sic.*, vol. 13, pp. 1883–1894.

Kamogawa, H. (1980) *Sen-l* Gakkaishi, vol. 36(3), pp. 96–102.

*Primary Examiner*—Leo B. Tentoni

*Attorney, Agent, or Firm*—Darby & Darby

[57] ABSTRACT

Synthetic textiles containing a photochromic pigment. The pigments are prepared by encapsulating a photochromic pigment in a thermoplastic polymer having a high melt flow index, mixed with a primary thermoplastic resin, and extruded at a temperature of less than 250° C. through a spinnerette having a diameter of at least 0.3 ml.

13 Claims, 3 Drawing Sheets

METHOD OF MAKING SYNTHETIC FIBERS CONTAINING PHOTOCHROMIC PIGMENT

BACKGROUND OF THE INVENTION

The present invention relates to synthetic textiles containing photochromic pigments.

Photochromic pigments are those which reversibly change color when exposed to light. Generally the color-change inducing light has a wavelength in the visible or near visible range. Other factors which may affect the color of these pigments include temperature, moisture, electricity, and gases. Photochromic pigments have previously been applied to textiles by coating processes. Such coated textiles have aesthetic qualities associated with the photochromic pigments. However, these textiles are not sufficiently color-fast and their aesthetic qualities are readily destroyed by soiling.

Due to the thermal lability of photochromic pigments, it has proved difficult to directly incorporate such pigments into synthetic fibers.

BRIEF DESCRIPTION OF THE INVENTION

It has now been discovered that photochromic pigments can be blended into resinous fibers, yarns or non-woven textiles without substantial loss of photochromic properties. The dye used can be introduced into this process from a master pigment batch obtained by mixing chromogenic pigments with a low melting polymer In the process, the dye is blended with resin (the "primary resin") and the mixture is processed into textiles by spinning and drawing or by the spin-bond process. In addition, the invention relates to filaments, fibers and textile material made therefrom.

The textiles manufactured by the process of the present invention are advantageous over the prior art coated products in that the resultant photochromic pigment-containing textiles are more durable (e.g., more color-fast), more brightly pigmented, easily laundered after staining (e.g., by soil, solvents or oil) and readily woven directly into the desired fashion.

DETAILED DESCRIPTION OF THE INVENTION

Figure 1:
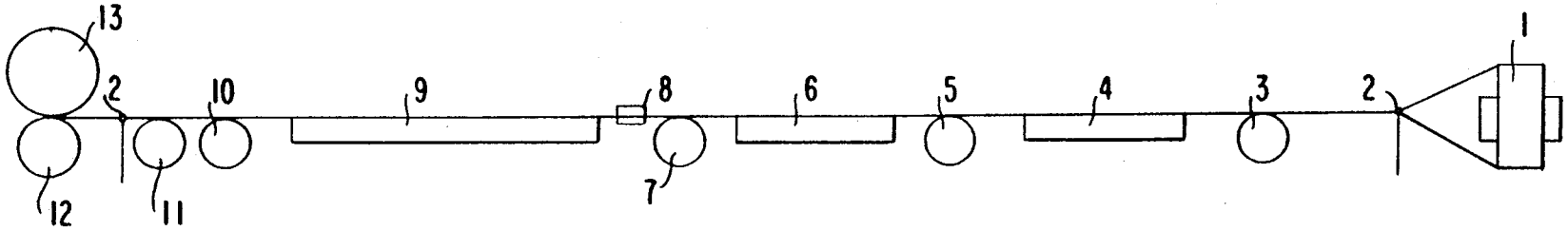
FIG. 1 is an illustration of an apparatus which may be used to perform the process of the invention.

Generally, conventional methods of blending polymers and dyes and of extruding synthetic fibers or non-woven textiles are used in the presently claimed process. For instance, blending can be done in a fusion type metric mixer, a volumetric type mixer or a weight type mixer. The processes that may be used to manufacture the fibers or non-woven textiles include spinning and drawing processes, continuous spin-draw processes and spun-bond processes for the manufacture of non-woven textiles. However, these processes are modified in accordance with the invention such that the photochromic dye is not subjected to a temperature in excess of about 250° C., preferably not in excess of about 200° C.

Preferably, the photochromic dye is introduced into the polymer mixing process in a "masterbatch" of polymer-encapsulated dye pellets. Such photochromic dye pellets have been described in Republic of China Patents Nos. 70105505 and 78108893 (hereby incorporated by reference in their entirety into the present specification). Generally, the amount of pigment in the masterbatch is from 1 to 10%, preferably from about 2 to 7%. The use of dye pellets in place of directly adding dye facilitates uniform mixing and enhances the throughput of the overall process.

The encapsulating polymers used in the masterbatch have a high melt-flow index, generally from 20 to 100 g/10 min., preferably from about 30 to 50. Useful encapsulating resins include polypropylene, polyethylene, low-melting nylons, low-melting polyesters and mixtures thereof. As used in this context, low-melting shall mean, generally, having a melt temperature of less than about 250° C., preferably less than about 230° C.

For use in the production of synthetic fibers or non-woven textiles containing photochromic pigments, the masterbatch is mixed with a "primary" resin, which may or may not be the same as the carrier resin in the masterbatch. The amount of masterbatch blended with the primary resin ranges from 1:2 to 1:100. The resins used as the primary resin are those with a melting point between about 105° C. and about 215° C. Useful resins include polypropylene, polyethylene, polyolefins copolymers and terpolymers thereof as for example ethylene-propylene copolymers and ethylene-propylene diene terpolymers. Additionally, polyamides, such as nylon 6, nylon 66, nylon 8, nylon 11, nylon 12 and blends thereof; and polyesters, such as poly(ethylene terephthalate) (PET) and poly(butylene terephthalate) (PBT) and copolymers or blends thereof are useful in the invention. The foregoing polymers may be modified to give them the necessary low melting and flow characteristics. For example, in making PBT, isophthalic or adipic acid monomer may be used as monomer to modify the polymer.

The spinneret used in connection with the extrusion process of the present invention preferably has a cross-sectional diameter between about 0.3 mm and 0.9 mm, more preferably between about 0.4 mm and 0.7 mm. The length to diameter ratio of the holes may be between 2 and 5, preferably from 2 to 3.

Generally, any photochromic dye that is resistant to decomposition at the extrusion temperatures required to practice the present invention are anticipated to be useful in the present invention. More particularly, photochromic dyes that do not decompose substantially during processing are useful in the present invention. Generally, the compositions are maintained at the processing temperatures for a maximum of 10 minutes, preferably for not more than 7 minutes.

Preferably, the photochromic dye useful in the present invention has the following formula:

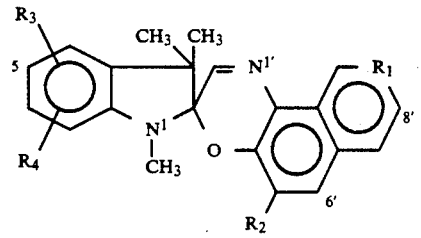

where $R_1$, $R_2$, $R_3$ and $R_4$ are each either hydrogen, halogen or lower alkyl. Preferably, all of the R groups may be hydrogen, $R_1$ and $R_2$ are hydrogen and $R_3$ and $R_4$ are methyl, or $R_1$ and $R_2$ are methyl and $R_3$ and $R_4$ are hydrogen.

The specific polychromic acid used in the following examples has the formula:

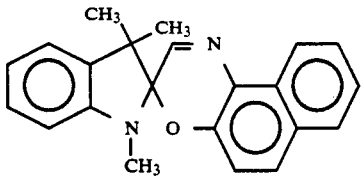

Additional fillers and pigments, such as talc, silica, titanium dioxide, calcium carbonate, and conventional organic pigments, may be added either to the masterbatch or during the final fiber or non-woven textile manufacture process (e.g., spinning and drawing). The non-chromic pigment may range from 0.001% to 0.1%, while the amount of filler is from 0.01 to 0.5% based on the weight of the extruded material.

It has been found that varying the cross-sectional shape of fibers according to the present invention (triangular, rhombic, star-shaped, etc.) varies the optical effects of the fibers. Such variations are within the scope of the present invention.

It will be recognized by those skilled in the art that fiber made by the process of the present invention can be blended with other types of textile fibers to complement or alter their appearance.

FIG. 1 diagrams an apparatus that may be used in the practice of the present invention having: (1) feeder material; (2) a guider; (3) a feed roller; (4) a heating plate for the first drawing zone; (5) a first drawing roller; (6) a heating plate for the second drawing zone; (7) a second drawing roller; (8) a nozzle; (9) a heating plate for the fixing zone; (10) a setting roller; (11) a oiling roller; (12) a take-up roller; and (13) a bobbin.

The present invention is illustrated by the following nonlimiting example.

EXAMPLE

Two different masterbatches, containing either purple-red photochromic pigment or purple-blue, described in R.O.C. Patent No. 70105505, and polypropylene having a melt flow index of 35 were blended in a volumetric mixer at a temperature of 210° C. In each case, the masterbatch contained 1% wt. photochromic dye. The dyes were encapsulated in polypropylene. The masterbatch and polypropylene were blended in a 1:12 wt. ratio.

The resultant mix was extruded into fibers using an extrusion apparatus having 5 heating zones operated using the parameters in Tables I and II. The extruding device was a pilot type (screw diameter 30 mm) manufactured by Fourne of Germany.

In Table II the total drawing ratio means the surface speed of roll 7 versus that of roll 3. It is calculated by using the following equation:

Drawing Ratio $= V_7/V_3$, where $V_7$ = Speed of roll 7 and $V_3$ = Speed of roll 3.

The setting over-feed means the surface speed of roll 10 versus that of roll 7. It is calculated by using the following equation:

Setting Over-Feed $= 1 - V_{10}/V_7$, where $V_{10}$ = Speed of roll 10 and $V_7$ = Speed of roll 7.

TABLE I

| Heating Zone Temperatures | | | | | | |
|---|---|---|---|---|---|---|
| Heating Zone: | 1 | 2 | 3 | 4 | 5 | 6 |
| Temperature (°C.): | 160 | 175 | 185 | 200 | 205 | 205 |

TABLE II

| Other Parameters of the Spin-Drawing Process | |
|---|---|
| Temperature at spinning nozzle: | 210° C. |
| Drawing speed: | 600 m/min. |
| Quenching air speed: | 0.6 m/min. |
| Quenching air temperature: | 10° C. |
| Oil pick-up | 0.8% |
| Total drawing ratio: | 3.6 |
| Drawing temperature: | 100° C. |
| Setting over-feed: | 6% |
| Setting temperature: | 120° C. |
| Drawing speed: | 300 m/min. |

Figure 2A:
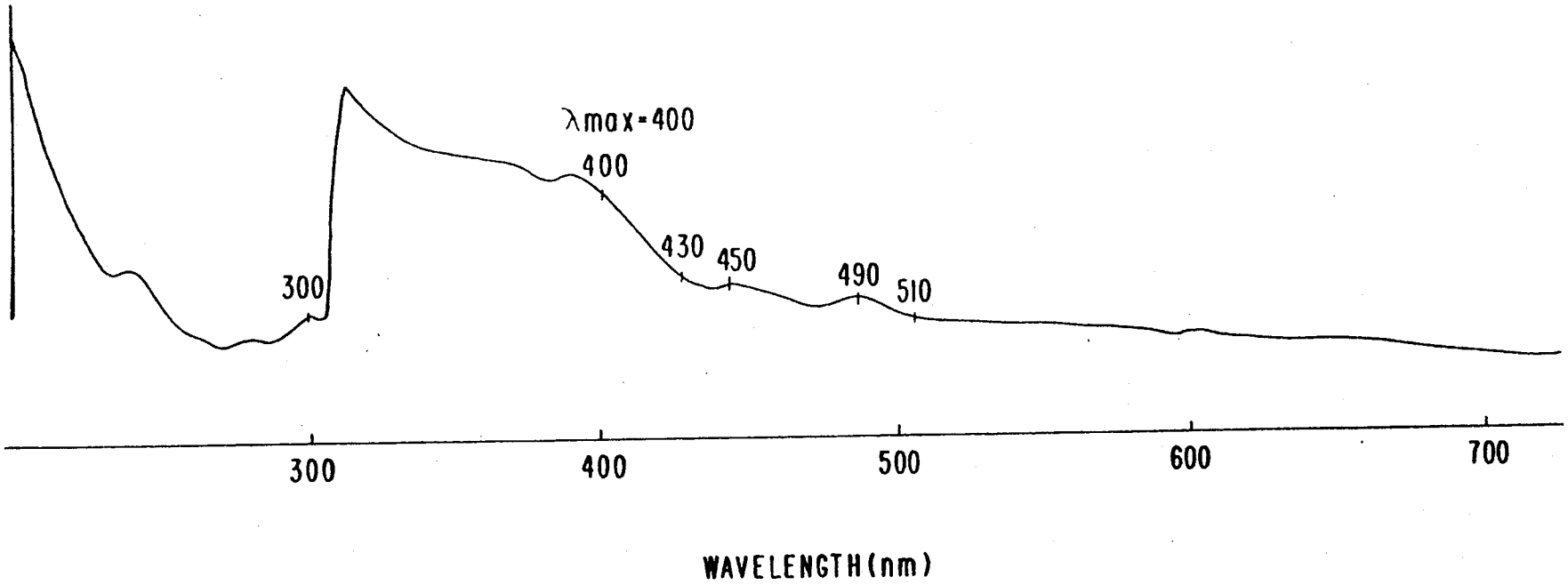
FIG. 2*a* is a UV-VIS spectrum of product made from a purple-blue masterbatch and polypropylene.
Figure 2B:
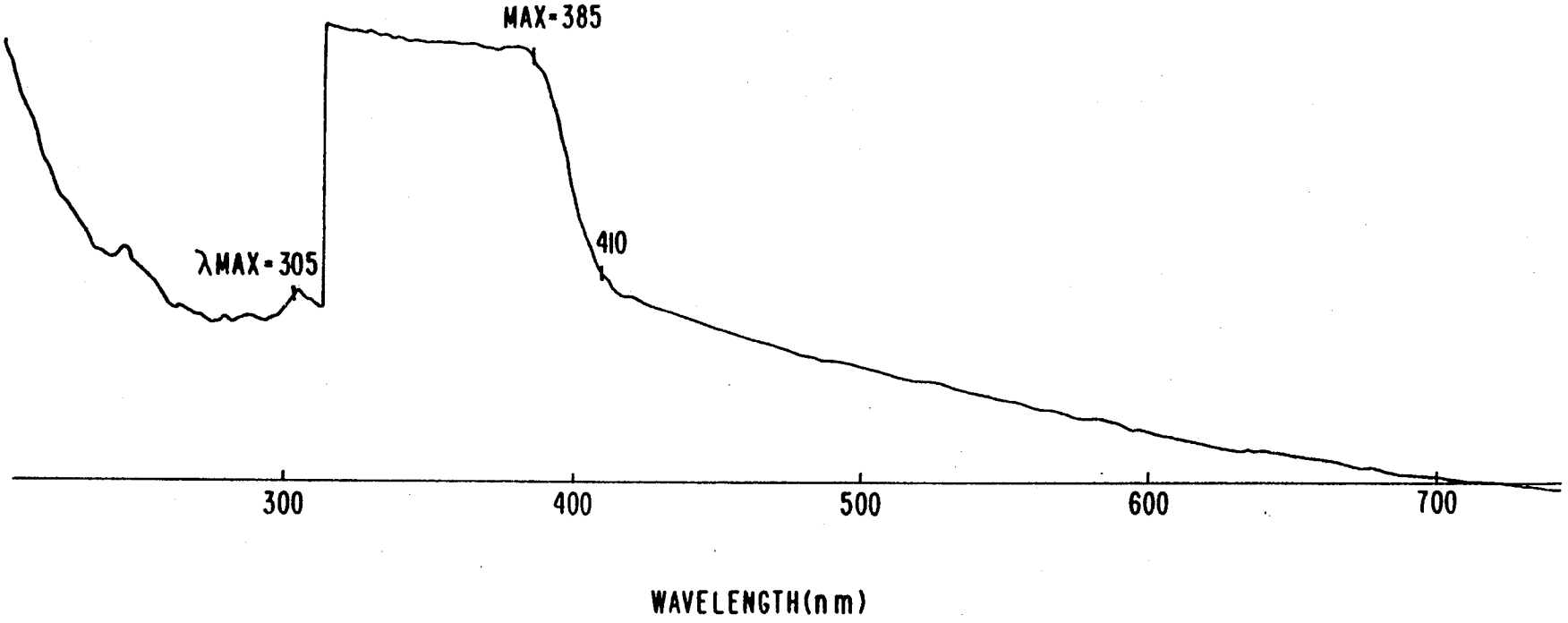
FIG. 2*b* is a UV-VIS spectrum of product made from a purple-red masterbatch and polypropylene.

Both photochromic pigment-containing fibers obtained by this process exhibited photochromic behavior as shown in the UV/VIS spectra in FIGS. 2*a* and 2*b*. The spectrum in FIG. 2*a* shows light absorption by the purple-blue fibers at wavelengths ranging between 300 nm and 400 nm. This is the orange/yellow region of the spectrum. Light absorption in this region of the spectrum indicates purple-blue color. FIG. 2*b* shows a similarly obtained spectrum of the purple-red product where light absorption is seen in the 305 to 385 nm region, which indicates purple-red color. Both products are colorless (clear) in the dark and adopt their characteristic color in broad-band light (e.g. sunlight).

Many additions and omissions to the invention as claimed below will be apparent to those of ordinary skill in the art in light of the present teachings. Such modifications are within the scope of the present invention.

What is claimed is:

1. A process for the preparation of a synthetic fiber containing a photochromic pigment which comprises:

admixing (a) a photochromic pigment which is encapsulated in a thermoplastic polymer having a high melt-flow index and (b) a primary thermoplastic resin having a melting point of less then 215° C., and extruding said admixture at a temperature of less than 250° C. through a spinneret having a diameter of at least 0.3 mm so as to form said synthetic fiber.

2. The process of claim 1 wherein the photochromic pigment has the formula

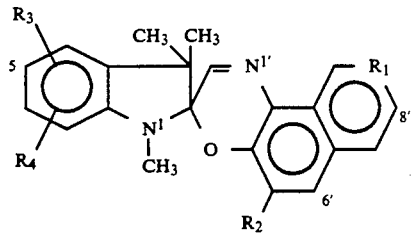

where $R_1$, $R_2$, $R_3$ and $R_4$ are each either hydrogen, halogen or hydrocarbyl.

3. The process of claim 2 wherein $R_1$, $R_2$, $R_3$ and $R_4$ are hydrogen.

4. The process of claim 1 wherein the encapsulating thermoplastic polymer is a low melting polyamide.

5. The process of claim 4 wherein the low melting polyamide is selected from the group consisting of nylon 8, nylon 12, nylon 6, nylon 66, and admixtures thereof.

6. The process of claim 1 wherein the encapsulating thermoplastic polymer is a polyolefin.

7. The process of claim 6 wherein the polyolefin is selected from the group consisting of polyethylene, polypropylene, and a blend thereof.

8. The process of claim 1 wherein the encapsulating thermoplastic polymer is selected from the group consisting of a low melting polyethylene terephthalate and polybutylene terephthalate.

9. The process of claim 1 wherein the primary thermoplastic resin is selected from the group consisting of a low melting polyamide, polyolefin, and polyalkylene terephthalate.

10. The process of claim 9 wherein the primary thermoplastic resin has a melt flow index ranging from 20 to 100 g/10 min.

11. The process of claim 1 wherein the photochromic pigment in the encapsulating thermoplastic polymer is in an amount ranging from 1 to 10% by weight.

12. The process of claim 1 wherein the synthetic fiber contains from 1% to 10% of the photochromic pigment.

13. The process of claim 1 wherein the ratio of the photochromic pigment encapsulated in a thermoplastic polymer to the primary thermoplastic resin ranges from 1:2 to 1:100.

* * * * *